United States Patent [19]

Marben

[11] 4,284,267

[45] Aug. 18, 1981

[54] VARIABLE CONTOUR VICE JAW

[75] Inventor: Ronald D. Marben, 1101 E. 132nd St., Burnsville, Minn. 55337

[73] Assignees: Dennis M. Thayer; Ronald D. Marben; Ralph DeJarlais; Edward DeJarlais, all of Minneapolis, Minn.

[21] Appl. No.: 134,077

[22] Filed: Mar. 26, 1980

[51] Int. Cl.[3] ..... B25B 1/24

[52] U.S. Cl. ..... 269/266

[58] Field of Search ..... 269/266, 267, 283, 20

[56] References Cited

U.S. PATENT DOCUMENTS

| | | | |
|---|---|---|---|
| 824,394 | 6/1906 | Warner | 269/266 X |
| 1,453,176 | 4/1923 | Perrine | 269/266 X |
| 2,486,494 | 11/1949 | Rice . | |
| 2,579,995 | 12/1951 | Atchison | 269/283 X |
| 2,754,708 | 7/1956 | Peterson . | |
| 2,882,771 | 4/1959 | Blazek . | |
| 3,604,700 | 9/1971 | Gault . | |
| 3,698,267 | 10/1972 | Denney . | |
| 3,818,646 | 6/1974 | Peterson . | |
| 3,858,468 | 1/1975 | Pasbrig . | |
| 3,868,102 | 2/1975 | Pevar . | |

*Primary Examiner*—Robert C. Watson

*Attorney, Agent, or Firm*—Merchant, Gould, Smith, Edell, Welter & Schmidt

[57] ABSTRACT

A variable contour vice jaw. A vice (10) having variable contour vice jaws (12, 14) is disclosed for clamping of irregularly shaped objects. Housing (26, 126) receives piston (50, 150) which is truncated (58, 158) and has a jaw contact member (64, 163) removably affixed thereto. Plate (44, 144) is affixed to housing (26, 126) and prevents piston (50) from being removed from housing. Bore (28, 128) is filled with an incompressible fluid with pistons (50, 150) half extended. Jaw contact member (64, 163) move in and out to conform to the shape of an irregularly shaped member held within vice jaws (12, 14).

18 Claims, 8 Drawing Figures

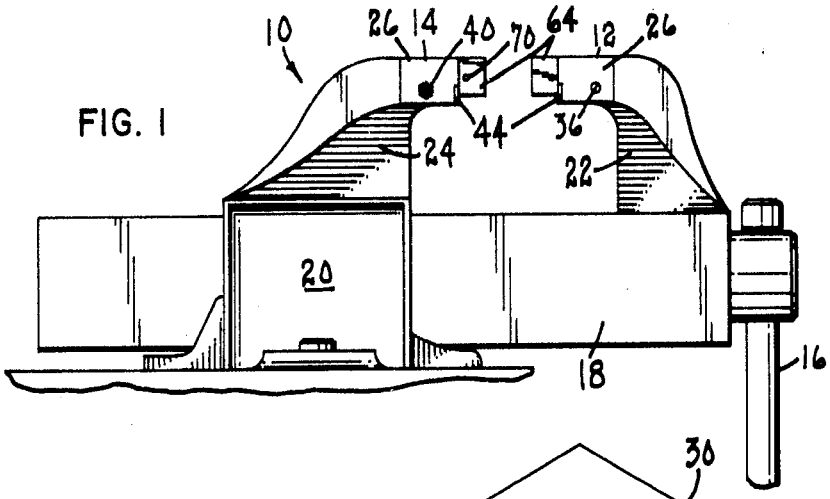
FIG. 1
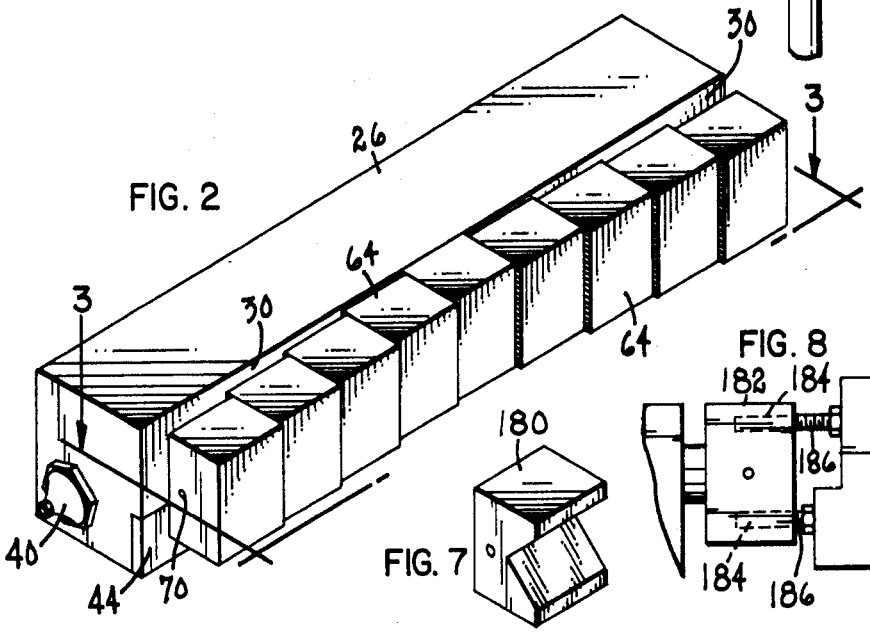
FIG. 2
FIG. 7
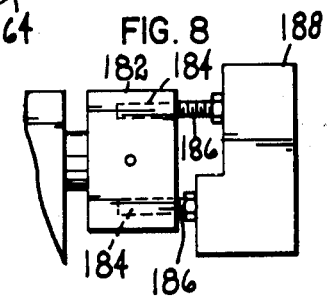
FIG. 8
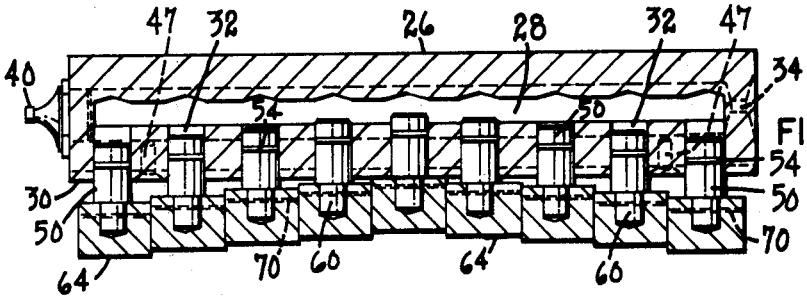
FIG. 3

FIG. 4
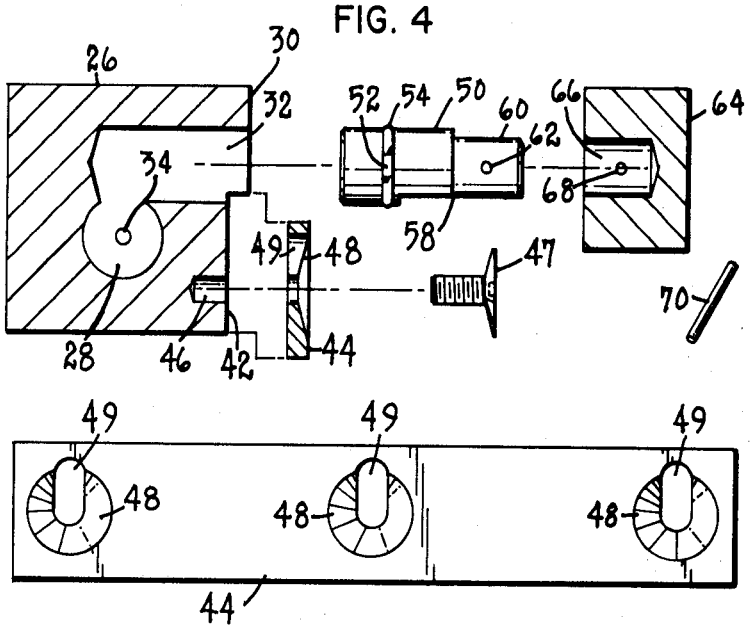
FIG. 5
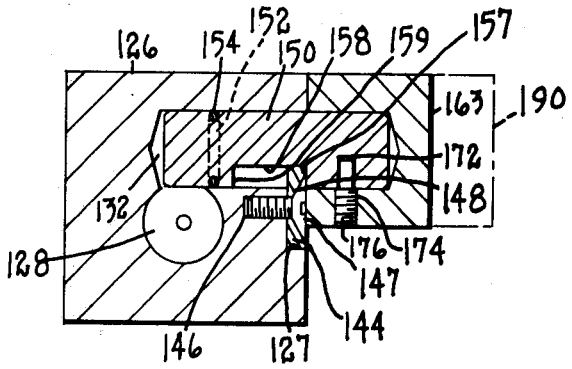
FIG. 6

VARIABLE CONTOUR VICE JAW

TECHNICAL FIELD

The present invention relates to the field of clamping tools, more particularly devices used for clamping contoured objects within a vice.

BACKGROUND OF THE INVENTION

Work holding devices, such as vices and clamps are necessary for holding a workpiece immobilized while further machining or the like is done on the piece. The standard vice having parallel opposed jaws is well suited for objects having planar surfaces. Unfortunately such a vice cannot adequately secure a workpiece having a contoured surface. The use of contour conforming clamping devices has made it possible for irregularly shaped objects to be adequately secured without creating pressure points which may cause damage to the workpiece.

A number of such contour conforming clamping devices are known in the prior art. Many of them employ a plurality of finger-like members which adjust to the shape of the object over its irregular surface. One such device, disclosed in the patent issued to Peterson, U.S. Pat. No. 2,754,708 shows spring-loaded members which exert pressure against the workpiece. More sophisticated devices are shown in patents issued to Blazek, U.S. Pat. No. 2,882,771 and patent issued to Pevar, U.S. Pat. No. 3,386,102. These devices employ plungers which rely on hydraulic fluid pressure to exert force on the workpiece. These fluid systems work well in that they can more evenly apply high pressure to the workpiece without causing damage at any one point. The fluid system, however, requires expensive milling of the vice jaw housing to receive the plungers and to prevent loss of hydraulic fluid. In addition, should the jaw members be damaged or become worn through repeated contacts with the workpiece, the device must be completely disassembled to replace these parts.

The present invention provides a fluid operated system for creating a contour conforming vice jaw which is simple to construct and provides for easy replacement of elements.

SUMMARY OF THE INVENTION

The present invention is directed to a variable contour vice jaw which includes a housing having a front face into which a plurality of bores are made, the bores being in fluid communication with each other, a plurality of pistons sized to be received within these bores, each piston being truncated toward one end so that a portion of the piston is removed, and a stop means which is affixed to the front face so that the stop means limits the outward travel of the pistons. A plurality of jaw segments are also included which are removably affixed to the ends of the pistons. The jaw segments provide the contact surface between the workpiece and the vice. Means are provided for injecting fluid into the bores creating a closed hydraulic system in operative relationship with the pistons.

According to another aspect of this invention, means are provided to bleed air out of the bores and fill the resulting space with fluid.

According to another aspect of the invention, jaw segments are provided with adjustable means on their front face to provide fine adjustment for irregularly shaped workpieces.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there are illustrated and described preferred embodiments of the invention.

BRIEF DESCRIPTION OF THE DRAWINGS

FIG. 1 is a side elevation of a vice including the present invention;

FIG. 2 is a prospective view of a variable contour vice jaw;

FIG. 3 is a view taken along lines 3—3 of FIG. 2;

FIG. 4 is an exploded sectional view of a portion of the jaw of FIG. 2;

FIG. 5 is a front elevation of plate 44 which is partially visible in FIG. 2;

FIG. 6 is a sectional view of the preferred embodiment of the present invention;

FIG. 7 is a perspective view of an alternate embodiment of a jaw contact member;

FIG. 8 is a side elevation of a further embodiment of a jaw contact member.

DETAILED DESCRIPTION OF THE INVENTION

Referring to the drawings in detail, there is shown in FIG. 1, a variable contour vice generally designated by the numeral 10 having variable contour vice jaws 12 and 14. Vice 10 has a crank pin 16 for moving rail 18 which rides in vice housing 20. Affixed to rail 18 is one of the jaw supports 22, the remaining jaw support 24 extending from housing 20. Variable contour vice jaws 12 and 14 are affixed to jaw supports 22 and 24 respectively. Jaws 12 and 14 are identical and therefore only one will be discussed in detail. Since jaws 12 and 14 are identical, different ends of the respective jaws appear in FIG. 1 as an end reversal results when identical jaws are used for both left and right hand sides of the vice. Vice 10 is shown to include two jaws 12 and 14. This is desirable for highly contoured workpieces; however, one variable contour jaw, 12 or 14, can be used together with an ordinary planar jaw surface.

Variable contour vice jaw 14 can be seen in greater detail in FIGS. 2–4. Jaw 14 includes a housing 26 which has a central bore 28 which runs parallel to the front face 30 of housing 26. Central bore 28 is intersected by a plurality of cross bores 32 which extend from bore 28 to front face 30. Central bore 28 provides fluid communication between cross bores 32. Alternative methods of manifolding bores 32 are acceptable. At one end of bore 28 is bleeder hole 34 which is threaded to receive screw 36 (shown in FIG. 1). Hole 34 countersunk such that screw 36 will create a fluid-tight seal when tightened. The other end of central bore 28 has threads (not shown) in its interior so that it may receive a one-way fluid valve such as a zerk fitting 40. Fitting 40 provides means for injecting fluid into bores 28 and 32 thereby creating a closed hydraulic system.

Front face 30 of housing 26 has a recessed portion 42 which extends partially over cross bores 32. Plate 44 fits into this recess portion 42 and is affixed to housing 26 by screws 47 which are threaded into holes 46. When plate 44 is so affixed, the front face of housing 26 appears completely flush. Plate 44 contains holes 48 which are in alignment with holes 46 and which are countersunk with a keyhole pattern 49 as shown in FIGS. 4 and 5. Keyhole pattern 49 permits plate 44 to be lowered slightly out of the way of cross bores 32 without the need to remove screws 36 completely. The purpose of this arrangement will be discussed in detail hereinafter.

Sized to be received within cross bores 32 are pistons 50, which are preferably cylindrical in shape. It is, however, not essential that pistons 50 be cylindrical so long as they are the same shape as cross bores 32 and may slide freely therewithin. Toward one end of each piston 50 is groove 52 which has an O-ring 54 fitted thereon. The O-ring is designed to prevent fluid contained within bores 28 and 32 from escaping. A portion of the body of piston 50 is truncated or cut off to create a recessed portion 58. This preferably accomplished by flatfiling or milling about two thirds of the length of the piston so that it has a flat face for a portion of its length.

End 60 of piston 50 is milled to have a smaller diameter than the overall diameter of the piston. This end has an aperture 62 therethrough.

In order to protect the pistons from damage in contacting a workpiece and provide a greater contact area, jaw contact members 64 are provided. Contact members 64 are preferably blocks of hard metal having a countersunk bore 66 therein sized to receive end 60 of pistons 50. Contact member 64 also includes an aperture 68 located to align with aperture 62 when end 60 of the piston is received within countersunk bore 66. A roll pin or other fastener 70 is inserted into apertures 62 and 68 to removably attach contact members 64 to their respective piston 50. Contact members 64 are sized so that they will be in near contact with each other when pistons 50 are inserted into cross bores 32 as shown in FIG. 2.

The device is assembled as follows. O-ring 54 is placed within groove 52 of piston 50. End 60 of piston 50 is inserted into countersunk bore 66 of member 64 and roll pin 70 is inserted through apertures 68 and 62 affixing the piston to the contact member 64. Plate 44 is loosely attached to housing 26 by means of screws 47 such that plate 44 will not block the openings to bores 32. This is possible because of the keyhole pattern 49 of holes 48. Pistons 50 are then inserted into cross bores 32. Plate 44 is then securely tightened against housing 26. A portion of plate 44 will then extend into bore 32.

Plate 44 limits the travel of the pistons so pistons 50 can slide outward until the end of the recessed section 58 contacts plate 44. Pistons 50 can travel inward until contact member 64 touches front face 30, thereby stopping the piston.

Prior to adding fluid to the system, vice 10 should be adjusted by means of crank 16 so that jaw contact member 64 of jaws 12 and 14 are in contact and are about half extended from their maximum travel outward from front face 30. Fluid, preferably incompressible such as grease, is then pumped into central bore 28 by means of fitting 40 until a portion of the fluid begins to run out bleeder hole 34. When fluid leaks out the bleeder hole, the majority of air will have been driven out of the system. Screw 36 may then be tightened sealing the fluid system.

Jaws 12 and 14 may be affixed to supports 22 and 24 by welding or by fasteners drilled through housing 26 (not shown) or other means. It is not necessary to use both jaws 12 and 14 with vice 10. In some vices or clamps, jaws 12 and 14 need not be affixed to supports 22 and 24. Instead, they may rest on rail 18. A vice having such a flat bed rail is shown in U.S. Pat. No. 2,754,908 issued to Peterson.

In operation, with the system partially injected with fluid as described above, jaw contact members 64 will follow the contour of an irregularly shaped workpiece when the vice is tightened onto a workpiece. Wherever a jaw member is pushed inward the fluid displaced by the piston connected to it, will cause another jaw member to move outward according to known hydraulic principles.

As contact members 64 or pistons 50 become worn from use, they may be easily replaced without disassembly of the entire system. Screws 47 are loosened allowing plate 44 to drop out of the way of cross bores 32. At that point any piston and its associated contact member may be removed. Contact members 64 may be replaced by removal of roll pin 70. The system is then reassembled as described above and the air in the system should be bled out through bleeder hole 34 and the system repressurized.

ALTERNATE PREFERRED EMBODIMENT

In an alternate embodiment which at present is the preferred embodiment, the variable contour vice jaw is constructed as shown in FIG. 6 of the drawings. Housing 126 has a central bore 128 and a plurality of cross bores 132 (only one shown) similar in arrangement to that shown in FIG. 3 of the drawings. As in the previous embodiment, fluid is maintained within bores 128 and 132 by means of a bleeder fitting (not shown) and Zerk one-way grease fitting (not shown) corresponding identically to bleeder hole 34 and fitting 40 shown in FIG. 3 of the previous embodiment. Housing 126 differs from housing 26 of the previous embodiment only in terms of the portion of housing which receives new front plate 144 in the preferred embodiment. Plate 144 does not extend to the bottom of housing 126 but instead rests on housing portion 127. Plate 144 has three countersunk holes 148 drilled therewithin similar to that of plate 44 in FIG. 5 with the exception that holes 148 and of a simple countersunk configuration lacking the keyhole pattern 49 of holes 48. Screws 147 secure plate 144 to housing 126 by means of threaded holes 146.

Pistons 150 (only one of which is shown) are similar in shape to pistons 50 of the previous embodiment with the following exceptions. Each piston 150 has a recessed portion 158 which extends only through a mid-section of the piston. Edge 159 of the recessed portion acts as an outward stop for the piston travel and edge 157 acts as an inward stop for piston travel when the piston comes in contact with plate 144. As in the previous embodiment, pistons 150 included groove 152 and an O-ring 154 which provides a fluid seal.

Each piston includes a jaw contact member 163 which is removably affixed to the piston. In the preferred embodiment, the piston has a countersunk bore 172 and the jaw contact member 163 has a threaded bore 174 in alignment with bore 172. To secure contact member 163 to piston 150, a set screw 176 is threaded through bore 174 into bore 172 where it makes secure contact thereby fixing the contact member to the piston. Broken lines 190 show the location of member 163 when piston 150 is fully extended.

The preferred embodiment is assembled in the following manner. Piston 150 are inserted within bores 132. Plate 144 is then affixed to housing 126 by means of screws 147. It may be necessary to withdraw pistons 150 slightly so that plate 144 can be located behind edge 147 in piston 150. Once the plate has been installed, jaw contact members 163 can then be affixed to pistons 150 by means of screw 176. Should contact members 163 require replacement, this can be accomplished by simply removing screw 176. Plate 144 need not be removed unless it is desired to replace a piston.

The operation of the preferred embodiment and the fluid pressurization of the hydraulic system therewithin, is identical to that of the previous embodiment.

FIGS. 7 and 8 illustrate some of the alternative jaw contact members which may be employed. Jaw contact member 180 in FIG. 7 shown as a V-shaped member which is particularly suitable for clamping cylindrically shaped objects such as bottles or pipe etc. Contact member 180 is shown suitable for attachment to the first embodiment of the present invention however, by addition of a bore 174 it is readily apparent that member 180 can be used for either embodiment. Similarly, contact member 182 shown in FIG. 8 illustrates an alternative embodiment to contact members 63 and 163. In this embodiment, member 182 has threaded borings 184 in its front face which receives threaded hex head screws 186. Screws 186 may then be adjusted to accommodate an unusually uneven workpiece 188. Alternatively other length adjustable members may be used in place of screws 186. In addition jaw contact members may have knurled front faces or be covered with resilient or non stratch materials such as plastic or rubber so as to prevent damage to a workpiece held in the jaw.

Numerous characteristics and advantages of the invention have been set forth in the foregoing description, together with the details of structure and function of the invention, and the novel features thereof are pointed out in the appended claims. The disclosure, however, is illustrative only, and changes may be made in detail, especially in matters of size, shape, and arrangement of parts, within the principles of the invention, to the sole extent intended by the broad general meaning of the terms in which the appended claims are expressed.

What is claimed is:

1. A variable contour vice jaw, comprising:

(a) a housing having a front face and a plurality of bores extending through said front face;

(b) a plurality of piston members each having first and second ends, sized to be received within said bores with said first end extending through said front face, a portion of each piston member being truncated, between said first and second ends;

(c) stop means removeably affixed to said housing for engaging said end point of said truncated portion whereby said piston members are prevented from sliding out of said bores; and (d) means for interconnecting said bores to provide a closed hydraulic system in operative relationship with said piston members; and (e) means for injecting fluid into said hydraulic system.

2. A vice jaw according to claim 1 wherein said stop means includes a plate removably affixed to said front face, said plate extending over a portion of said bores.

3. A vice jaw according to claim 2 wherein said plate includes means for moving said plate away from said bores without removing said plate from said front face.

4. A vice jaw according to claim 1 wherein said truncated portion includes a section of each of said piston members which is removed thereby forming flat surface.

5. A vice jaw according to claim 1 wherein said piston members are cylindrical in shape and wherein said bores are parallel to each other with axes of said bores being coplanar.

6. A vice jaw according to claim 1 including sealing means for preventing fluid within said bores from escaping said housing via space between said piston members and said bores.

7. A vice jaw according to claim 1 including a replaceable jaw segment removably affixed to each of said piston members for contacting a workpiece to be held by said jaw.

8. A variable contour vice jaw for use in a vice comprising:

(a) a housing having a front face and a plurality of bores, said bores extending through said front face;

(b) a plurality of pistons sized to be received within said bores, said pistons having a first end to be extended through said front face;

(c) stop means affixed to said housing and each of said pistons for limiting the travel of said pistons through said front face;

(d) a plurality of replaceable jaw segments for contacting material to be held in the vice, each of said segments having a rear face, each of said rear faces having a bore sized to receive said first end of said piston;

(e) means removably affixing each of said segments to said pistons; and (f) means for interconnecting said bores to provide a closed hydraulic system in operative relationship with said pistons; and (g) means for injecting fluid into said hydraulic system.

9. A vice jaw according to claim 8 wherein each of said pistons has an aperture therethrough located toward said first end and wherein each of said segments has an aperture therethrough located to align with said piston aperture when said piston is received within said segment and wherein said affixing means includes a fastener inserted into said segment and piston apertures for removably affixing said segments to said pistons.

10. A vice jaw according to claim 8 wherein each of said pistons has a boring partially extending therethrough and wherein each of said segments has an aperture therein located to align with said piston boring and wherein said affixing means includes a fastener inserted into said aperture and said boring to removably secure said segment and piston together.

11. A variable contour vice jaw for use in a vice comprising:

(a) a housing having a front face, said housing having a first bore extending longitudinally within said housing and a plurality of cross bores perpendicular to said first bore and extending therefrom to said front face;

(b) a plurality of pistons each having first and second ends sized to be received within said cross bores with said first ends extending through said front face, a portion of each piston being truncated between said first and second ends;

(c) a plate affixed to said front face, said plate extending over a portion of said cross bores so that said pistons in said cross bores are prevented from sliding out of said cross bores by contact of said plate with the endpoint of said truncated section;

(d) a plurality of jaw segments removably affixed to said first ends of said pistons for contacting material to be held by the vice; and (e) means for injecting fluid into said bores and for sealing said fluid within said bores to create a closed hydraulic system in operative relationship with said pistons.

12. A vice jaw according to claim 11 wherein said jaw segments have a V-shaped front face.

13. A vice jaw according to claim 11 wherein said jaw segments are knurled.

14. A vice jaw according to claim 11 wherein said jaw segments are made of a material which will not scratch a workpiece held therewithin.

15. A vice jaw according to claim 11 wherein said segments each have a front face and wherein said front face includes adjustable means protruding outward from said face whereby an irregularly shaped workpiece may be accomodated within said jaw.

16. A vice jaw according to claim 15 wherein said adjustable means includes threaded fasteners.

17. A variable contour vice jaw for use in a vice comprising:

(a) a housing having a front face provided with a first bore extending longitudinally within said housing parallel to said front face, said housing further having a plurality of cross bores extending perpendicularly from said first bore to said front face;

(b) a plurality of pistons sized to fit within each of said cross bores, each of said pistons having first and second ends and a section of its outer surface truncated, said truncated section starting at said first end of each of said pistons and ending at a point between said first and second ends, each of said pistons further having a circumferential groove in its outer surface, said groove located toward said second end each of said pistons further having an aperture therein located perpendicular to its longitudinal dimension;

(c) sealing means located within said groove of each of said pistons for creating a fluid barrier between said pistons and said cross bores;

(d) a plate affixed to said front face of said housing, said plate extending over said cross bores by a distance equal to or less than said truncated section on each of said pistons so that said pistons are prevented from being removed from said housing when said plate comes in contact with the end of said truncated section, said plate including slotted fastening holes which permit said plate to be lowered away from said cross bores without removal of said plate from said front face;

(e) a plurality of jaw segments for contacting material to be held by the vice, having a countersunk bore for receiving a portion of said piston, said segment further having an aperture located to align with said piston aperture when said piston is received within said countersunk bore;

(f) a roll pin to be snugly received within said piston aperture and said segment aperture for securing said piston and segment together;

(g) bleeder means in fluid communication with said first bore for permitting fluid to be controllably released from said housing; and (h) a fluid input means for controllably admitting fluid into said first bore, said input means located in said housing.

18. A variable contour vice jaw for use in a vice comprising:

(a) a housing having a front face provided with a first bore extending longitudinally within said housing parallel to said front face, said housing further having a plurality of cross bores extending perpendicularly from said first bore to said front face;

(b) a plurality of pistons sized to fit within each of said cross bores, each of said pistons having first and second ends and a section of its outer surface truncated, said truncated section located between said first and second ends of said pistons, each of said pistons further having a circumferential groove in its outer surface, said groove located toward said second end each of said pistons further having a boring extending into said piston located perpendicular to its longitudinal dimension;

(c) sealing means located within said groove of each of said pistons for creating a fluid barrier between said pistons and said cross bores;

(d) a plate affixed to said front face of said housing, said plate extending over said cross bores by a distance equal to or less than said truncated section on each of said pistons so that said pistons are prevented from being removed from said housing when said plate comes in contact with the end of said truncated section;

(e) a plurality of jaw segments for contacting material to be held by the vice, having a bore for receiving a portion of said piston, said segment further having a threaded aperture located to align with said piston boring when said piston is received within said bore;

(f) a set screw to be snugly received within said threaded aperture and said segment boring for securing said piston and segment together;

(g) bleeder means in fluid communication with said first bore for permitting fluid to be controllably released from said housing; and (h) a fluid input means for controllably admitting fluid into said first bore, said input means located in said housing.

* * * * *